United States Patent [19]

Takagi

[11] Patent Number: 4,619,723

[45] Date of Patent: Oct. 28, 1986

[54] METHOD FOR PREFORMATION OF CUSHION AND APPARATUS THEREFOR

[76] Inventor: Sadaaki Takagi, 39, Mikage-cho, Okazaki-shi, Aichi-ken, Japan

[21] Appl. No.: 292,907

[22] Filed: Aug. 14, 1981

[30] Foreign Application Priority Data

| | | | |
|---|---|---|---|
| Aug. 18, 1980 | [JP] | Japan | 55-112664 |
| Aug. 18, 1980 | [JP] | Japan | 55-112665 |
| Jun. 23, 1981 | [JP] | Japan | 56-95960 |

[51] Int. Cl.[4] ..... D04H 1/48

[52] U.S. Cl. ..... 156/62.2; 19/296; 19/301; 156/296; 264/119; 264/121; 425/80.1

[58] Field of Search ..... 19/296, 304, 305, 306, 19/161.1, 301; 128/290 P; 425/80.1, 82.1, 83.1; 264/119, 121, 128, 518; 28/112, 107; 156/62.4, 62.2, 296, 148, 228

[56] References Cited

U.S. PATENT DOCUMENTS

| | | | |
|---|---|---|---|
| 2,902,395 | 9/1959 | Hirschy et al. | 156/62.2 |
| 2,923,030 | 2/1960 | Himmelheber et al. | 19/301 |
| 3,034,180 | 5/1962 | Greiner et al. | 19/305 |
| 3,413,688 | 12/1968 | Songesand et al. | 19/301 |
| 4,172,174 | 10/1979 | Takagi | 156/296 |
| 4,263,093 | 4/1981 | Shenk | 264/119 |

*Primary Examiner*—Michael Ball

*Attorney, Agent, or Firm*—Gordon W. Hueschen

[57] ABSTRACT

A method for the preformation of a cushion for a seat, characterized by feeding an aggregate of three-dimensional curled short-fiber filaments to conveyor means, causing said conveyor carring thereon said aggregate of filament to be advanced under a rotary member provided on the outer surface thereof with a multiplicity of raised needles and kept in rotation and allowing said needles to come into contact with said aggregate of filaments thereby scraping part of the filaments from said aggregate and giving to said aggregate of filaments a prescribed shape.

17 Claims, 17 Drawing Figures

FIG. 1
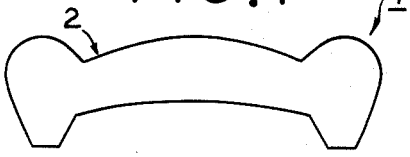
FIG. 2
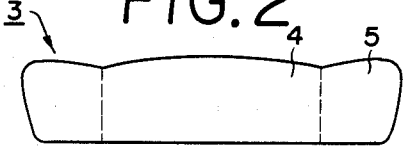
FIG. 4
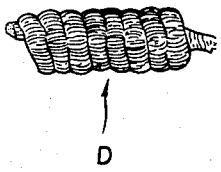
FIG. 3
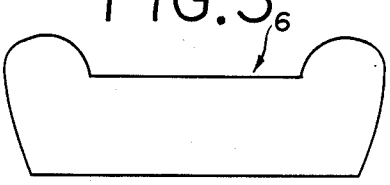
FIG. 5
FIG. 14
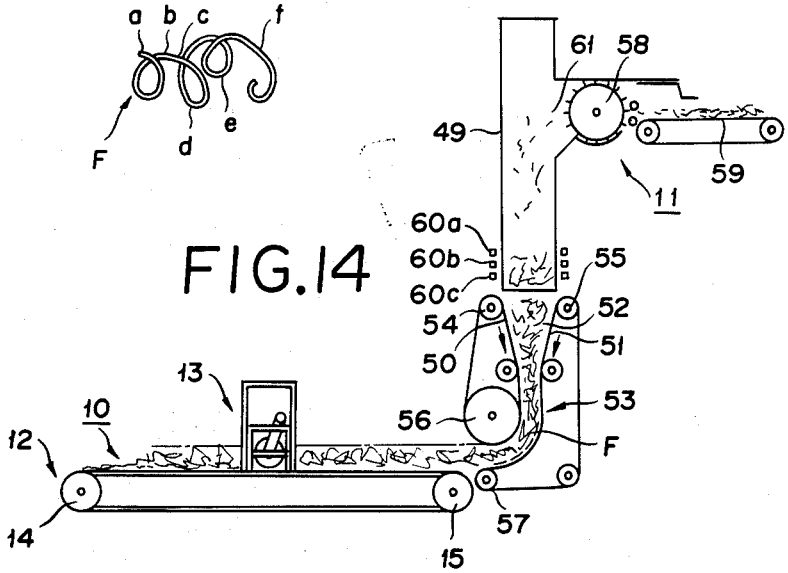

METHOD FOR PREFORMATION OF CUSHION AND APPARATUS THEREFOR

FIELD OF INVENTION AND PRIOR ART

This invention relates to a method for the preformation of a cushion and to an apparatus for the preformation. More particularly, this invention relates to a method for the preformation of a cushion made of an aggregate of three-dimensionally curled synthetic fiber filaments and used as in a seat or bed and to an apparatus for the preformation of the cushion.

According to the inventor's earlier discovery, a cushioning material obtained by cutting three-dimensional crimped filaments to a prescribed length, wadding the cut filaments into a mass, disentangling the filaments from the mass and at the same time compressing then into a required shape and uniting the individual adjacent filaments at the points of their mutual contact by use of an adhesive agent possesses high impact resilience, shows permeability to gas, and excels in cushioning property. According to the inventor's further discovery (U.S. Pat. No. 4,172,174) a cushioning material of a construction obtained by wadding synthetic filaments containing three-dimensionally crimped filaments into a mass and uniting the individual adjacent filaments in the mass at the points of their mutual contact by use of an adhesive agent exhibits still better properties when the curls in the filaments of the cushioning material are shaped so as to acquire directionality partially and, consequently, the portions in which curled or crimped filaments assuming various shapes during their extractive and contractive deformation are allowed to entangle more densely than in other portions are formed in the direction in which the applied load is desired to produce its impacts and the portions of such concentrated entanglement are distributed in proportion to the desired load strength (U.S. Pat. No. 4,172,174).

This cushioning material is manufactured by compressing a wad of three-dimensionally crimped filaments into an aggregated block of filaments of a stated bulk density by means of an endless belt and/or a roller or some other means, needling the shaped block to a stated needle density with needles each provided with barbs and, with or without a subsequent rubbing treatment, either spraying an adhesive agent downwardly onto the shaped block of filaments on an endless belt in motion in a substantially horizontal direction or immersing the shaped block of filaments in a bath of the adhesive agent and lifting it from the bath, and thereafter drying the wet block of filaments on the endless belt running in a substantially horizontal direction by heating.

According to such a method, however, the bulk density of the filament aggregate block depends on the amount (volume) of three-dimensionally curled filaments to be supplied and the degree of compression of the filaments. For the filament aggregate block produced by this method to acquire a fixed bulk density, therefore, the amount of the three-dimensionally curled filaments to be supplied and the degree of compression of the filaments must be kept constant. While it is relatively easy to keep constant the degree of compression of the filaments, it is extremely difficult to keep the amount of supply of the filaments constant. For example, these three-dimensionally curled filaments are exceptionally bulky and readily compressible under a very slight pressure and, therefore, highly susceptible to change of volume. Generally, the supply of these filaments is effected by the force of wind which is generated by an opener, for example. The amount of the filaments to be supplied, therefore, is varied by the change in the volume of wind generated and the change in the amount of three-dimensionally curled filaments to be fed to the opener. It is, therefore, difficult to keep constant the amount (such as layer height) of three-dimensionally curled filaments deposited on a belt conveyor in motion, for example. Consequently, the layer of filaments thus deposit on the conveyor belt an undulating surface. A possible device for uniformizing the layer height of such deposited filaments may comprise using a blade adapted to flatten the undulating surface by a raking motion. Since the three-dimensionally curled filaments are readily compressed even by a very slight pressure as described above, such a device entails the disadvantage that the blade as soon causes variation in the bulk density of the filaments as it is allowed to uniformize the layer height of the filaments.

The conventional method described above, through applicable to continuous production of a cushion for a bed which possesses uniform cushioning property (rigidity) and thickness and comes in a rectangular shape, is not readily applicable to the production of a cushion for an automobile seat which possesses a vertically asymmetrical, rugged profile and involves partially varied distribution of rigidity. This fault handicaps the conventional method. In the production of a cushion 1 for a seat in a profile such as is shown in FIG. 1, for example, although the surface contour of this cushion can be formed by attaching to the surface of an endless belt a molding die conforming to this surface contour and causing the supplied filaments to be deposited on this molding die so as to produce the desired contour on the underside of the deposited layer of the filaments, it is extremely difficult to impart a depression 2 to the underside of the cushion automatically by a mechanical method. In the case of a cushion 3 for a seat which, in its finished shape, is not expected to contain any depression but is required to possess low rigidity in the central portion 4 and high rigidity in the circumferential edge portion 5 as illustrated in FIG. 2, it becomes necessary to heighten the compression ratio of the three-dimensionally curled filaments along the circumferential edge portion 5. To meet this requirement, a depression 6 must be formed as illustrated in FIG. 3 by decreasing the layer thickness in the central portion for which a low compression ratio suffices and increasing the layer thickness in the circumferential edge portion for which a high compression ratio is indispensable. Unfortunately, however, the aggregate of three-dimensionally curled filaments is as fluffy as a mass of cotton and, upon exposure to the pressure of a rigid body, is readily compressed and consequently forced to induce a change in bulk density in the affected portion. Thus, it has been extremely difficult to have the aggregate of filaments automatically formed in such a shape as described above by a mechanical method without entailing any change in the bulk density.

The aggregate of three-dimensionally curled filaments which has been molded in a rugged profile as described above is now subjected to a needling treatment, processed by application of an adhesive agent, and is subsequently dried. If in this case, the aggregate is dried by being drawn upwardly, it tends to sustain breakage during the ascent because the thickness of the aggregate of filaments is not uniform.

OBJECTS OF THE INVENTION

An object of this invention, therefore, is to provide a method for the preformation of a cushion which possesses uniform bulk density.

Another object of this invention is to provide a method for the preformation of a cushion such as for an automobile seat which is required to possess an asymmetrical, complicate profile and partially varied rigidity distribution.

Yet another object of this invention is to provide an apparatus for the manufacture of such a preformed cushion as mentioned above.

A further object of this invention is to provide a method for the manufacture of a cushion such as for an automobile seat which is required to possess an asymmetrical, complicate profile and partially varied rigidity distribution.

Still another object of this invention is to provide an apparatus for the manufacture of such a cushion as mentioned above.

SUMMARY OF THE INVENTION

All these objects are accomplished by a method for the preformation of a cushion, which is characterized by the steps of supplying an aggregate of three-dimensionally curled short-fiber filaments to conveying means, moving this conveying means and, at the same time, rotating a rotary member having a multiplicity of needles raised thereon thereby causing the needles to come into contact with the aggregate of short-fiber filaments, scrape off at least part of the aggregate, and impart a prescribed profile to the aggregate. This method of preformation is accomplished by an apparatus which comprises means for conveying an aggregate of three-dimensionally curled short-fiber filaments and scraping means extended over the conveying means throughout the entire width thereof and formed of a rotary member having a multiplicity of needles raised from the surface thereon.

The objects mentioned above are accomplished by a method for the manufacture of a cushion, which is characterized by the steps of feeding an aggregate of three-dimensionally curled short-fiber filaments onto a net being advanced to conveying means, moving this conveying means and, at the same time, rotating a rotary member having a multiplicity of needles raised from the surface thereof thereby causing the needles to come into contact with the aggregate of short-fiber filaments, scrape off at least part of the aggregate, and impart a prescribed shape to the aggregate by way of preformation, compressing the preformed aggregate thereby causing the aggregate to acquire prescribed bulk density, then applying an adhesive liquid to the preformed aggregate, lifting the preformed aggregate wet with the adhesive liquid in conjunction with the aforementioned net, and drying the aggregate by applying heat thereto during the ascent.

This method of the manufacture of a cushion is accomplished by an apparatus which comprises in combination sequentially along the process of manufacture, a cushion-preforming device composed of means for conveying an aggregate of three-dimensionally curled short-fiber filaments in conjunction with a net and scraping means disposed over the conveying means and formed of rotary member having a multiplicity of needles raised from the surface thereof, means for compressing the preformed aggregate of three-dimensionally curled short-fiber filaments in conjunction with the net, means for applying an adhesive liquid to the compressed aggregate, and means for drying the aggregate wet with the adhesive liquid.

The synthetic fibers which are advantageously used for the method of this invention are polyester, polyamide, polypropylene, etc. Among these, polyester is most desirable. The fiber as a monofilament is desired to have a thickness within the range of from 30 to 2,000 deniers, preferably from 50 to 1,000 deniers, and most preferably from 100 to 600 deniers. The filament is required to contain three-dimensional curls. By the term "three-dimensional curls" as used herein is meant those three-dimensional curls in the broad sense of the word, such as two directional and three-directional curls, for example. A three-directional three-dimensionally crimped filament is preferred. For example, a three-directional three-dimensionally crimped filament F illustrated in FIG. 5 is obtained by preparing a double-twist filament D illustrated in FIG. 4 by use of a method and an apparatus disclosed by the same inventor in the specification of U.S. Pat. No. 4,154,051 and then cutting the double-twist filament D to a prescribed length and untwisting it. The cut filaments aggregated in the wad are desired to have a length within the range of from 25 to 200 mm, preferably from 60 to 150 mm. Thus, with reference to FIG. 5, the part of the filament at "a" coils over the part at "b." The part at "c" coils over the part at "d." The part at "e," however, coils under the part at "f" and not over it. Thus, the section of the filament from "e" to "d" falls under two bites or coils of the helix. This is what may properly be called a disoriented helix and is very much like a helical telephone cord which gets out of whack when one of the coils thereof becomes disoriented with respect to the others.

BRIEF DESCRIPTION OF THE DRAWINGS

Now, the method and apparatus according to the present invention will be described below with reference to the accompanying drawings.

FIG. 1 is a schematic diagram of a cushion for a seat to be preformed by the method of the present invention.

FIG. 2 is a schematic diagram of a finished cushion.

FIG. 3 is a schematic diagram of a preformed aggregate for the manufacture of a cushion illustrated in FIG. 2.

FIG. 4 is a partial perspective view of a doubly twisted filament.

FIG. 5 is a front view of a three-dimensionally curled filament.

FIG. 14 is a schematic sectional view of another apparatus of this invention for the preformation of a cushion for a seat.

DESCRIPTION OF THE PREFERRED EMBODIMENTS

Now, one preferred embodiment of the method of this invention for the preformation of a cushion will be described with reference to the drawings.

Figure 6:
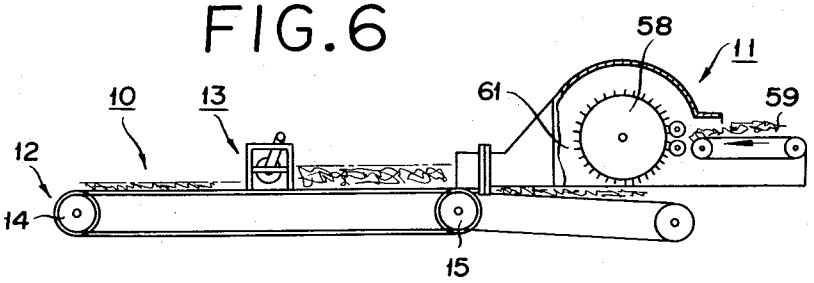
FIG. 6 is a schematic sectional view of an apparatus of this invention for the preformation of a cushion.
Figure 7:
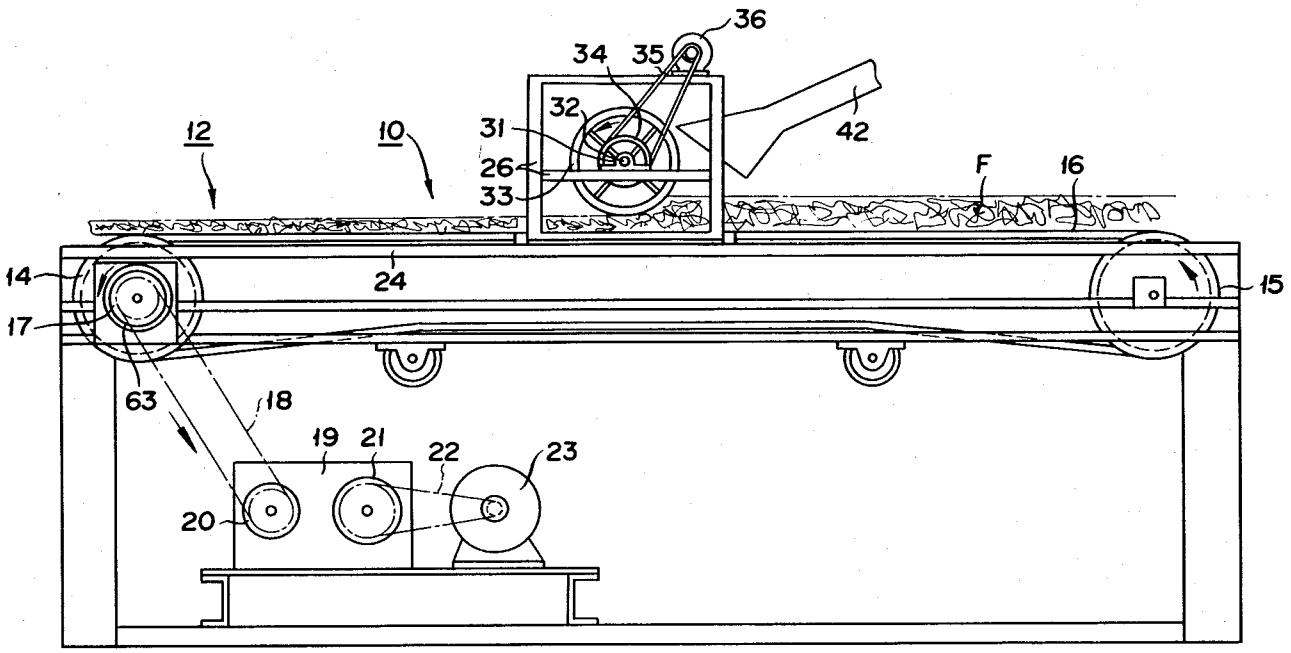
FIG. 7 is an enlarged side view of the apparatus for the preformation of FIG. 6.

The apparatus according to the present invention chiefly comprises the following components as illustrated in FIGS. 6–7. They are a preforming device 10 and a device 11 for supplying short-fiber filaments which is provided optionally. The preforming device 10 is mainly formed of means 12 for conveying filaments and scraping means 13 as illustrated in FIG. 7. The conveying means 12 is formed of an endless belt (such as an endless belt perforated after the pattern of a grating) or an ordinary endless belt stretched taut and interposed between chains 16 which are laid parallel to each other and passed over sprockets 14, 15 placed apart. Either one of the sprockets mentioned above (sprocket 14, in the illustrated embodiment) has a pulley 17 interlocked through the medium of a belt (or chain) with a pulley 20 which is mounted on a gear 19. Another pulley 21 of the gear 19 is interlocked through the medium of a belt (or chain) 22 with a motor 23.

The scraping means 13 is disposed above the aforementioned conveying means 12. As illustrated in FIG. 7, for example, support means 26 for the rotary member is disposed on a horizontal frame 24 of the conveying means 12. In a rotary member support means 25, a rotary member 33 is fastened to a shaft 32 rotatably supported on a bearing 31. This shaft 32 is interlocked with a motive power source (such as, for example, a motor or gear) 36 through the medium of a belt 35 passed over a pulley 34 fastened coaxially to the shaft 32. On the outer surface of the rotary member 33, a multiplicity of needles are raised as will be described more fully afterward. The rotary member support means 26 is desired to be designed so that the position at which the bearing 31 is disposed therein will be suitably adjusted with reference to the prescribed layer height (amount of scraping) of the aggregate of filaments, the diameter of the rotary member 33, and so on. Behind the rotary member 33, a suction duct 42 is disposed as interlocked with suction means (not illustrated).

Figure 8:
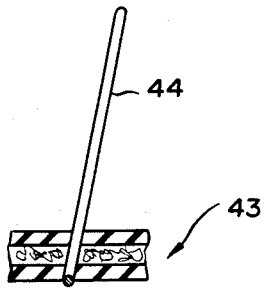
FIGS. 8–12 represent in cross section the needles usable in the apparatus of this invention.
Figure 9:
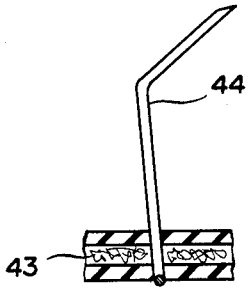
Figure 10:
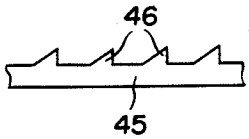
Figure 11:
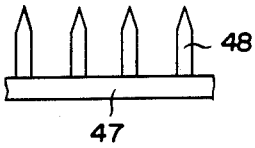
Figure 12:
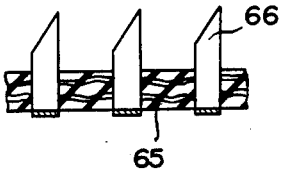
Figure 13:
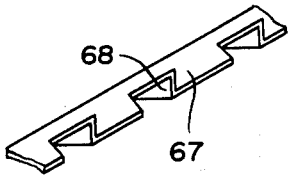
FIG. 13 is a perspective view of a needle.

The multiplicity of needles which are raised from the outer surface of the rotary member 33 may be in any of various forms. For example, card cloth, metallic, Teikain(slanted needles), and porcupine are available. The card cloth is what is obtained by planting metallic needles 44 of a diameter approximately in the range of from 0.2 to 2 mm, preferably from 0.2 to 1 mm, at a suitable density in a substrate layer 43 having cotton cloth, hemp cloth, rubber sheet, leather, etc. suitably laminated with the aid of an adhesive agent as illustrated in FIGS. 8–9. These needles may be in a straight form an illustrated in FIG. 8. Otherwise, they may be in a form bent in the shape of the letter L or in any other desired form. The length of these needles 44 is generally in the range of from 1 to 30 mm, preferably from 2 to 15 mm, from the surface of the substrate layer 43. The density at which the needles are planted on the substrate layer is desired to fall in the range of from 25 to 600 per in$^2$, preferably from 36 to 400 per in$^2$. Although the angle which the needles 44 form with the tangential lines on the outer surface of the rotary member when the card cloth is fastened to the rotary member 33 is variable with the length of needles and the density of the distribution of needles on the substrate layer, it generally falls in the range of from 45° to 100°, preferably from 70° to 90°, relative to the direction opposite the direction of rotation, where the needles have a straight form. The metallic is what is obtained by having metallic saw-toothed strips 45 containing teeth at intervals of about 5 to 20 mm, preferably 7 to 15 mm as illustrated in FIG. 8 wound densely in the circumferential direction on the surface of the rotary member 33. These teeth are raised to a height in the range of from 1 to 5 mm and are spaced at a rate in the range of from 5 to 20 teeth per inch. Alternatively, what is obtained by raising a multiplicity of needles 48 from a substrate 47 to a height of about 4 mm as spaced at a rate of 1 to 10 needles per inch as illustrated in FIG. 11, or what is obtained by raising a multiplicity of teeth 66 from a fiber-reinforced rubber substrate 65 as illustrated in FIG. 12, may be used. The Teikain is what is obtained by inserting cuts in a substrate strip 67 and forming teeth 68 by raising cut corners as illustrated in FIG. 13. The strips with raised cut corners thus obtained are wound in the circumferential direction on the surface of the rotary member.

The rotary member 33 is formed in the shape of a cylinder having a fixed diameter throughout its axial length. It is required to possess a length such that the rotary member produces a scraping action throughout the entire width of the aggregate of three-dimensionally curled filaments being deposited on the conveying means. The diameter of the rotary member may be suitably selected to suit the shape, length, and density of the needles to be used, the revolution speed of the rotary member, the condition of curls in the three-dimensionally curled filaments, and so on.

The feed means 11 for short-fiber filaments is formed of a conveyor 59 for the supply of filaments and an opener 58, for example, as illustrated in FIG. 6. This opener 58 is disposed close to the conveying means 12 of the preforming means 10.

Now, the method of this invention for preforming a cushion for a bed by use of the aforementioned apparatus will be described. Three-dimensionally curled synthetic short-fiber filaments F of a heavy denier as shown in FIG. 5 are forwarded to the opening 58 by conveying means such as the belt conveyor 59 as illustrated in FIGS. 6–7. With the pressure of wind, for example, they are discharged out of an outlet 61 and deposited on the conveying means 12 of the performing device 10. The filaments F thus delivered are piled up on the conveying means 12 and then advanced toward the scraping means 13.

In the meantime, the motive force of the motor 23 is adjusted to a prescribed revolution number by means of the gear 19, transmitted through the belt 18 to the pulley 17. The rotational force thus imparted to the pulley 17 sets the sprocket 14 rotating, with the result that the endless belt of the conveying means 12 is put into motion. Thus, the aformentioned aggregate of filaments F is passed through the interior of the scraping means 13. From this aggregate, the surface portion is scraped off by the needles on the outer surface of the rotary member 33 which is being rotated by the motive force conveyed via the belt 35 from the motor 36. Those filaments which have thus been scraped off the passing aggregate are removed by suction in the suction duct 42. In this case, the rotary member is operated at a peripheral speed in the range of from 150 to 2,000 m/min., preferably from 400 to 1,500 m/min. The height of the layer of the aggregate of filaments can be adjusted by either changing the diameter of the rotary member 33 or changing the height of the bearing 31.

Optionally, the aggregate of filaments which has been preformed as described above may be passed further through rubbing means, there to be compressed to a prescribed bulk density by being rubbed with bars, for example. Generally, the preformed aggregate of filaments obtained as described above has a bulk density in the range of from 0.002 to 0.5 g/cm$^3$, preferably from 0.05 to 0.2 g/cm$^3$.

The preformed aggregate of filaments F is transferred on a conveyor by a method such as is disclosed in U.S. patent application Ser. No. 107,364 issued Mar. 4, 1980 as U.S. Pat. No. 4,298,418 into an adhesive liquid bath, immersed in the adhesive liquid, and then lifted in a vertical or substantially vertical direction by another conveyor. During the ascent of the aggregate from the bath, possible drip of the adhesive liquid from the aggregate can be prevented to some extent by virtue of the surface tension of the liquid. Mean while, the excessive adhesive liquid adhering to the aggregate of filaments F flows down the interior of the aggregate. Then, the aggregate is passed through a high-frequency dielectric heater so that the water or solvent contained in the adhesive liquid adhering to the aggregate is very quickly expelled. At the same time, the adhesive liquid is hardened to some extent by the heat from the induction heater, causing the mutually touching points of the filaments to be bonded. The aggregate is further transferred on another conveyor and cut to a prescribed size. If there is a possibility that the preformed aggregate of filaments F will be torn when it is lifted in the vertical direction, then the aggregate while being transferred in the hirozontal direction en route to the immersion stage may be sprayed with a small amount of the adhesive liquid and dried to have part of the filaments temporarily bonded to preclude the possible tearing.

Typical examples of the adhesive agent to be used for the bonding of filaments include synthetic rubbers such as styrenebutadiene rubber, acrylonitril-butadiene rubber, chloroprene rubber, and urethane rubber, natural rubbers, vinyl acetate type adhesive agent, cellulose acetate type adhesive agent, and acrylic type adhesive agent. Such an adhesive agent is used in the form of latex, emulsion, or solution, preferably in the form of latex or emulsion. The amount of the adhesive agent to be applied on a solids basis is in the range of from 10 to 300 g/100 g of filaments, preferably from 50 to 250 g/100 g of filaments.

The aggregate of filaments F to which the adhesive liquid has been applied is passed through the heater. During the aggregate's travel through the heater, two rows of needles are alternately plunged into the aggregate at the upper and lower edges of the retaining guide. The insertion of the needless serves to prevent the aggregate of filaments F from being disintegrated when it is drawn upwardly and, at the same time, preclude otherwise possible leakage of high-frequency electric waves.

During its travel through the high-frequency dielectric heater, the aggregate of filaments F is exposed to an electric power emitted at a high frequency in the range of from 1 MHz to 300 GHz, preferably from 10 MHz to 30 GHz in a density enough for the adhesive liquid to be heated and dried to give a definite shape to the aggregate of filament, i.e. a density in the range of from 0.1 to 10 kwh/cm$^3$, preferably from 0.5 to 5 kwh/cm$^3$, for example. Consequently, the water or some other solvent used in the adhesive liquid is expelled by the heat and the mutually adjoining filaments in the aggregate are bonded with the hardened adhesive agent. Owing to the hardened adhesive agent, the preformed aggregate of filaments F, when drawn upwardly, will not be torn but its own weight plus the weight of the adhesive agent sticking to the filaments. When necessary, the preformed aggregate of filaments may be further passed through an ordinary drying furnace, there to be heated and after-hardened as with hot air, infrared rays, or superheated steam to a temperature in the range of from 80° to 200° C., preferably from 100° to 160° C., for a period in the range of from 10 to 60 minutes, preferably from 15 to 40 minutes. The after-hardened aggregate is cut to a prescribed size by a cutter.

When the finished cushion is required to possess better impact resilience, the aggregate of filaments F is subjected to a needling treatment by needling means before the aggregate is treated with the adhesive liquid. This needling is effected by using the method and apparatus disclosed in U.S. Pat. No. 4,172,174, for example, namely by plunging needles each provided at the leading end thereof with at least one barb into the aggregate at a suitable needle density as often as is required. Although the diameter and length of these needles are determined to suit the purpose of the needling, they are normally in the range of from 1.8 to 3.6 mm and in the range of from 50 to 2,000 mm respectively. They are generally provided with 4 to 12 barbs apiece. To be more specific, the needling is carried out by causing the block of preformed aggregate of filaments advancing on the belt conveyor to be supported from below by a flat plate such as, for example, a perforated plate, a slitted plate, or a slitted conveyor, vertically reciprocating a needle holder on the opposite side of the block through the medium of a bored plate such as, for example, a perforated plate or a slitted plate thereby needling the block of the aggregate of filaments at a suitable needle density. One or more rows of needles are attached fast at desired intervals to the needle holder. The vertical reciprotation of the needle holder is accomplished by rotating a crank shaft thereby driving a crank which is connected to the crank shaft and the needle holder. Meanwhile, the block of the aggregate of filaments is advanced forward at a speed such that the needles are plunged into the block at suitable intervals. The needle density is varied in a wide range so as to suit the purpose for which the cushion is used and the compression and resilience the finished cushion is desired to acquire. The needle density increases or the space between the needles decreases with the increasing compression and resilience. Generally, the needle density is in the range of from 1 to 100 needles per 100 cm$^3$ of block, preferably from 4 to 50 needles/100 cm$^3$ of block. The block of the aggregate of filament, after undergoing the needling treatment described above, is subjected to the treatment with the adhesive liquid and the drying treatment.

Alternatively, the compression of the filaments in the block may be accomplished by the rolling method or the rubbing method instead of the needling method described above. The compression by the rolling method is effected, for example, by causing needle holders each having a multiplicity of needles raised at prescribed intervals to be applied one each on the upper and lower surfaces of the block of filaments and squeezing the block with the needle holders while keeping at least one of the needle holders in a rolling motion.

Figure 15:
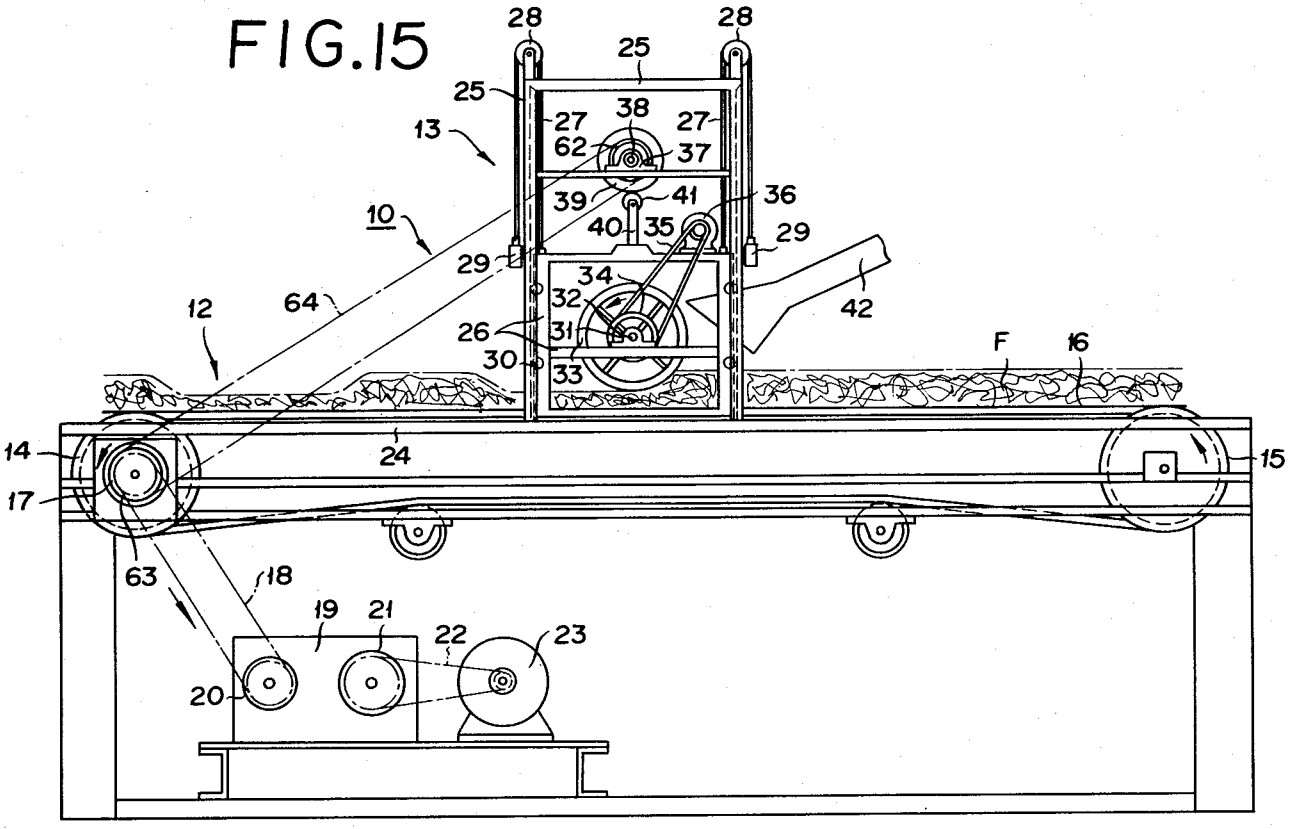
FIG. 15 is an enlarged sectional view of the apparatus for the preformation shown in FIG. 14.

FIGS. 14–15 represent another embodiment of the present invention. It mainly comprises the following components. They are preforming means 10 and short-fiber filament feeder means 11 which is provided when necessary. The preforming means 10 is mainly made up of short-fiber conveyor means 12 and scraping means 13 as illustrated in FIG. 15. The conveyor means 12 is formed by giving to the upper surface of an endless belt (such as an endless belt perforated after the pattern of a grating or an ordinary endless belt disposed between chains 16 stretched and passed around sprockets 14 and 15) a contour conforming to the countour desired for the under surface of the aggregate of filaments to be preformed (such as the shape corresponding to the under surface of a preformed aggregate illustrated in FIG. 1). The endless belt thus controured is in effect "a molding die". Of the pair of sprockets mentioned above, either one (sprocket 14 in the illustrated case) is interlocked to a pulley 20 of a gear 19 through the medium of a pulley 17 and a belt (or chain) 18. The other pulley 21 of the gear 19 is interlocked to a motor 23 through the medium of a belt (or chain) 22.

The scraping means 13 is disposed on the aforementioned conveyor means 12. As illustrated in FIG. 15, for example, a rotary member holder 26 is slidably inserted on the inside of a vertical frame 25 raised from a horizontal frame 24 of the conveyor means 12. The opposite terminals of the upper side of the rotary member holder 26 are connected to one end of a wire 27. This wire 27 is suspended from a pulley 28 fixed to the upper end of the aforementioned vertical frame 23. The other end of the wire 27 is connected to a weight 29. By the gravity of this weight 29, the aforementioned rotary member holder 25 is constantly kept pushed upwardly. Optionally, the rotary member holder 25 is provided on the lateral side thereof with rollers 30 which serve to enable the rotary member holder to be smoothly and easily moved vertically on the inner side of the vertical frame 25. Further in the rotary member holder 25, a rotary member 33 is fixed on a shaft 32 rotatably supported on a bearing 31. Through the medium of a pulley 34 coaxially fixed to this shaft 32, the shaft 32 is interlocked to a power source (such as a motor or gear) 36 via a belt 35. From the outer surface of this rotary member 33, a multiplicity of needles is raised similarly to the preformer of FIGS. 6–7. On the other hand, in the vertical frame 25, a cam plate 39 is fixed to a shaft 38 rotatably supported on a bearing 37 which is fixed to the vertical frame 25 in the upper position of the aforementioned rotary member holder 26. The cam face is constantly held in contact with a roller 41 rotatably pivoted to a stay 40 which is raised from the top of the aforementioned rotary member holder 26. Behind the rotary member 33, there is provided a suction duct 42 interlocked to suction means (not shown).

The multiplicity of needles raised from the outer surface of the rotary member 33 is similar to those already described with respect to the preformer of FIGS. 6–7.

The rotary member 33 can be formed in any desired shape to suit the shape of a depression to be formed in the preformed aggregate by scraping. Examples of the shape which the rotary member can assume include cylinder, beer barrel, two identical truncated cones joined at their major bases, sphere, egg, and calabash gourd. When the rotary member of such a shape is used, the needles raised from the outer surface are not required to have a uniform length or to be distributed at a uniform density. The length and the needle density may be locally varied to suit the occasion. Further, the number of such rotary member 33 need not be limited to one. There can be used a plurality of such rotary members to suit the contour desired to be given to the preformed aggregate of filament. When necessary, the preformed aggregate obtained as described above may have additional grooves formed therein by using a separate rotary member (not shown). Where the depression to be formed in the aggregate by scraping is in the form of a groove having a fixed depth, the rotary member holder 26 need not be vertically reciprocated by means of the cam plate 39 but may be fixed in a position.

The supply means 11 for short-fiber filaments comprises a filament feed inlet 49 possessing an opening in a substantially vertical direction as illustrated in FIG. 14. The opening area $S_1$ of this feed inlet 49 is invariable throughout the entire zone. Under the feed inlet 49 are disposed endless conveyors 50, 51 and a pair of opposed parallel guide plates (not shown). The upper portions of the paths of the endless conveyors 50, 51 are diverged relative to the upward direction to embrace therebetween a tapered part 52, and the lower portions thereof are disposed parallelly to each other to embrace therebetween a compression part 53. The upper opening of the tapered part 52 communicates with the lower end opening of the aforementioned feed inlet 49. This endless conveyor may be formed of a rubber belt or an endless series of metal pieces resembling a caterpillar tread. Otherwise, it may be formed by arranging a multiplicity of rollers serially at short intervals. Because the upper end of the compression part 53 is required to communicate with the lower end of the feed inlet 49, the upper portion of the compression part 53 must be formed in a vertical direction. The lower portion of the compression part 53 may be formed in a horizontal direction when necessary. The opposed portions of these endless conveyors 50, 51 are moved downwardly (in the direction shown by the arrows) by means of sprockets 54, 55, 56, and 57 which are connected to a power source (not shown). The area $S_2$ of the opening of the compression part 53 through which the aggregate of short-fiber filaments F is passed, particularly the opening at the extreme end thereof or the opening between the roller (not shown) disposed subsequently to the extreme end and the endless conveyors 50, 51, must be smaller than the area $S_1$ of the opening at the aforementioned feed inlet 49. Above the aforementioned feed inlet 49, the opener 58, the conveyor 59, etc. are disposed in series. As the feed means for filaments, there can be used a card (not shown) which forms webs of incoming filaments and piles one web on top of another. The height of the mass of filaments delivered to the feed inlet can be automatically controlled by a level controller (not shown) provided with detection **60*a*, 60*b*, and 60*c*** such as photoelectric tubes, photoluminescent diodes, or photo-transistors. The compression molding means for filaments need not be limited to what has been described above but may be constructed so that filaments will be delivered to a prescribed thickness on an endless belt in motion in a horizontal direction.

Now, the method for preforming a cushion for a seat by use of the apparatus mentioned above will be described below. Synthetic short-fiber filaments F of heavy denier three-dimensionally curled as shown in FIG. 5 are forwarded to an opener 58 by use of conveyor means such as a belt conveyor 59 as shown in FIGS. 14–15. Then, with the pressure of air, for example, they are discharged through the outlet 61 and fed into the feed inlet 49. The filaments F which have been fed in are gradually piled up in the lower portion of the feed inlet 49 and, at the same time, are brought down to the compression part 53. The aggregate of filaments F which is transferred by the operation of the endless conveyors 50, 51 is passed through the interior of the compression part 53. During this passage, this aggregate of filaments is compressed to a prescribed compression ratio (bulk density) by virtue of the relation between the area $S_1$ of the opening of the aforementioned feed inlet 49 and the area $S_2$ of the opening of the compression portion 53, namely the ratio $S_1/S_2>1$. Since the height of the pile of filaments F in the feed inlet 49 and the feed rate of the endless conveyors 50, 51 also affect the bulk density of the compressed aggregate of filaments F, the supply speed of the filaments F and the feed rate of the endless belts 50, 51 are controlled by having the height of the pile of filaments detected by means of detectors 60*a*, 60*b*, and 60*c*.

In the meantime, the motive power of the motor 23 is converted to a rotation of a prescribed rate by the gear 19 and then transmitted by the belt 18 to the pulley 17, with the result that the sprocket 14 is rotated to impart a motion to the endless belt 16 of the conveyor means 12. Thus, the aforementioned aggregate of filaments F is passed through the interior of the scraping means 13. From the aggregate, necessary portions are scraped off by the needles raised on the outer surface of the rotary member 33 as the rotary member 33 is rotated by the motive power generated by the motor 36 and conveyed through the belt 35. The filaments thus scraped off the aggregate are sucked off and removed by the suction duct 42. The peripheral speed of the rotary member during this operation is in the range of from 150 to 2,000 m/min., preferably from 400 to 1,500 m/min. The rotary member holder 26 is kept pulled upwardly at all times by the weight 29 attached to one end of the wire 27. The position of the rotary member holder 26, however, is controlled because the rollers 41 fastened to the top portion are kept pressed against the cam plate 39. Since the cam plate 39 is rotated by the motive power which is transmitted from the pulley 63 to the pulley 62 via the belt 64, the height of the rotary member 33 is determined by the rotation of the cam plate 39. The depression required to be formed in the aggregate of filaments F is accomplished by the change in the height of the rotary member 33. Optionally, the position of the rotary member holder 26 can be retained by the force of a spring instead of the gravity of the weight 29.

When necessary, the preformed aggregate of filaments F obtained as described above is further passed through rubbing means, there to be rubbed such as with bars and compressed to a prescribed bulk density. The preformed aggregate of filaments thus obtained generally possesses a bulk density in the range of from 0.002 to 0.5 g/cm$^3$, preferably from 0.05 to 0.2 g/cm$^3$.

This preformed aggregate of filaments F is subjected to the subsequent treatments for the application of an adhesive liquid and the application of heat similarly to the method of FIGS. 6–7. Where the finished cushion is expected to possess higher impact resistance, the aggregate of filaments is subjected to the needling treatment similarly to the method of FIGS. 6–7. The compression of filaments may be effected by the rolling method, the rubbing method, etc. instead of the needling method. The rolling method comprises vertically sandwiching the aggregate of filaments between plates each having a multiplicity of needles raised at prescribed intervals, squeezing the aggregate with the plates, and thereafter having at least one of the plates rolled under pressure.

Figure 16:
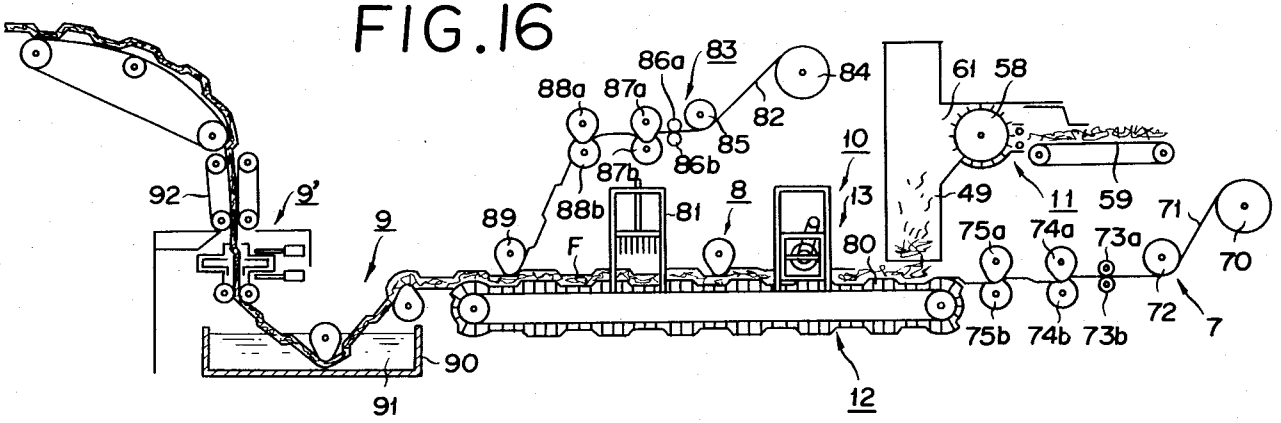
FIG. 16 is a schematic sectional view of an apparatus of this invention for the manufacture of a cushion.
Figure 17:
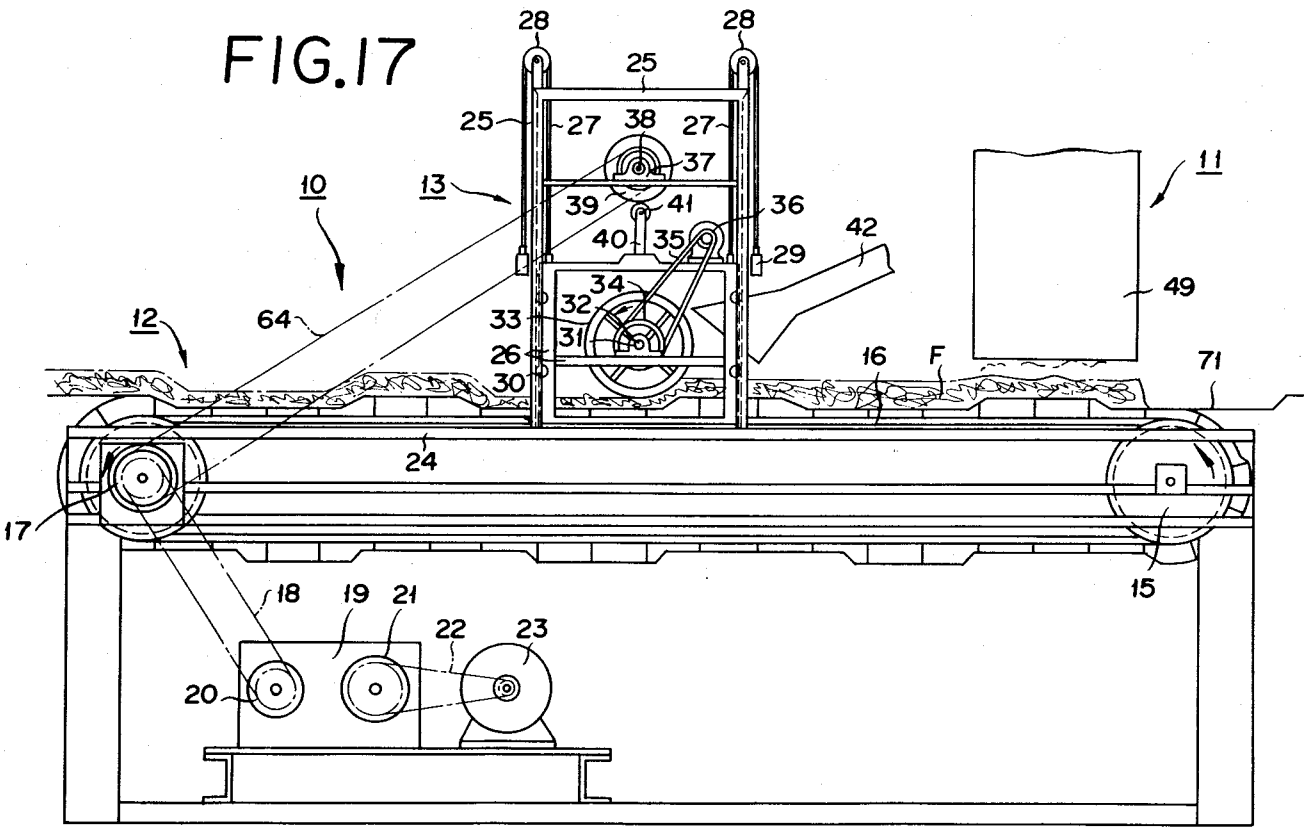
FIG. 17 is an enlarged side view of the preforming apparatus to be used in the apparatus of FIG. 16.

FIGS. 16–17 represent yet another embodiment of the present invention. This embodiment is mainly formed of the following components. They are net feed means 7, preformer 10, compression means 8, adhesive application means 9, drying means 9', and optionally short-fiber filament feed means 11. First, the net feed means 7 is only required to pay a net 71 off the roll 70 onto the preformer 7 where one surface, the lower surface, for example, of the aggregate of filaments to be preformed is flat. Where the one surface, the lower surface, for example, of the aggregate of filaments to be preformed is not even, there must be given a contour conforming to the uneven surface. As illustrated in FIG. 16, for example, the net 71 paid off the roll 70 is passed over the feed roller 72, pressed between the press rollers 73*a*, 73*b*, then molded by the molding rollers 74*a*, 74*b* to a prescribed shape such as is similar to the contour of the molding die 80 which will be described more fully afterward, and further pressed between similar press rollers 75*a*, 75*b*. In other words, the flat net 71 is pressed between the rollers 73*a*, 73*b* and again between the rollers 75*a*, 75*b* and molded to the prescribed shape by the molding rollers 74*a*, 74*b*. Since the net possesses the prescribed shape after the passage between the molding rollers, the press rollers 75*a*, 75*b* generally possess the same shape as the molding rollers 74*a*, 74*b*. The net 71 thus shaped is then transferred onto the molding die 80 on the conveyor means 12 of the preformer 10. The shaping of the net has been described as effected by means of rollers. Of course, it may be obtained by means of presses (not shown) instead.

The net is made of a plastic or metallic material. The meshes of the net have a fixed size in the range of from about 5 to about 100 mm, preferably from 10 to 50 mm. The wires making up the net generally have a diameter in the range of from 0.5 to 8 mm, preferably from 1 to 5 mm.

The preformer 10 is mainly composed of the short-fiber filament feed means 11, the conveyer means 12 and the scraping means 13 as illustrated in FIG. 17. The conveyor means 12 is formed by giving to the upper surface of an endless belt (such as an endless belt perforated after the pattern of a grating) or an ordinary endless belt stretched and interposed between the chains 16 laid parallel to each other and passed over the sprockets 14 and 15, a contour conforming to one surface of the aggregate of filaments to be preformed (such as the shape corresponding to the surface of a preformed aggregate illustrated in FIG. 1 where the aggregate is desired to be preformed in such a pattern) (split molding die 80). Of the pair of sprockets mentioned above, either one (sprocket 14 in the illustrated embodiment) is interlocked to the pulley 20 of the gear 19 through the medium of the pulley 17 and the belt (or chain) 18. The other pulley 21 of the gear 19 is interlocked to the motor 23 through the medium of the belt (or chain) 22.

The scraping means 13 is disposed on the aforementioned conveyor means 12 and is constructed in entirely the same way as the apparatus of FIG. 15. In FIG. 17, therefore, the same symbols as those of FIG. 15 designate the same components as those of the apparatus of FIG. 15. Further, the multiplicity of needles raised from the outer surface of the rotary member 33 are similar to those of the apparatus already described with reference to FIGS. 6–7.

The rotary member 33 can be formed in any desired shape to suit the shape of a depression to be formed in the preformed aggregate by scraping. Examples of the shape which the rotary member can assume include cylinder, beer barrel, two identical truncated cones joined at their major bases, sphere, egg, and calabash gourd. When the rotary member of such a shape is used, the needles raised from the outer surface are not required to have a uniform length or to be distributed at a uniform density. The length and the needle density may be locally varied to suit the occasion. Further, the number of such rotary member 33 need not be limited to one. There can be used a plurality of such rotary members to suit the contour desired to be given to the preformed aggregate of filaments. When necessary, the preformed aggregate obtained as described above may have additional grooves formed therein by using a separate rotary member (not shown). Where the depression to be formed in the aggregate by scraping is in the form of a groove having a fixed depth, the rotary member holder 26 need not be vertically reciprocated by means of the cam plate 39 but may be fixed in one position.

The supply means 11 for short-fiber filaments comprises a filament feed inlet 49 possessing an opening in a substantially vertical direction as illustrated in FIG. 16. The lower end of this feed inlet 49 opens over the conveyor means 12 of the aforementioned preformer 10. Over the feed inlet 49 mentioned above, the opener 58, the conveyor 59, etc. are disposed in series. As the supply means for filaments, there may be used a card (not shown) which forms webs of incoming filaments and piles one web on top of another.

Now, the method for performing a cushion for a seat by use of the apparatus mentioned above will be described below. Synthetic short-fiber filaments F of heavy denier three-dimensionally curled as shown in FIG. 5 are forwarded to the opener 58 by use of the conveyor means such as the belt conveyor 59 as shown in FIGS. 16–17. Then, with the pressure of air, for example, they are discharged through the outlet 61 and fed into the feed inlet 49. Consequently, the filaments are piled up to a prescribed thickness on the net in motion on the conveyor means.

In the meantime, the motive power of the motor 23 is converted to a rotation of a prescribed rate by the gear 19 and then transmitted by the belt 18 to the pulley 17, with the result that the sprocket 14 is rotated to impart a motion to the endless belt 16 of the conveyor means 12. Thus, the aforementioned aggregate of filaments F is passed through the interior of the scraping means 13. From the aggregate, necessary portions are scraped off by the needles raised on the outer surface of the rotary member 33 as the rotary member 33 is rotated by the motive power generated by the motor 36 and conveyed through the belt 35. The filaments thus scraped off the aggregate are sucked off and removed by the suction duct 42. The peripheral speed of the rotary member during this operation is in the range of from 150 to 2,000 m/min., preferably from 400 to 1,500 m/min. The rotary member holder 26 is kept pulled upwardly at all times by the weight 29 attached to one end of the wire 27. The position of the rotary member holder 26, however, is controlled because the rollers 41 fastened to the top portion are kept pressed against the cam plate 39. Since the cam plate 39 is rotated by the motive power which is transmitted from the pulley 63 to the pulley 62 via the belt 64, the height of the rotary member 33 is determined by the rotation of the cam plate 39. The depression required to be formed in the aggregate of filaments F is accomplished by the change in the height of the rotary member 33. Optionally, the position of the rotary member holder 26 can be retained by the force of a spring instead of the gravity of the weight 29.

The aggregate of filaments F which has been preformed as described above is compressed by the compression means 8 to a prescribed bulk density. This compression means 8 is a roller similar to the press roller 74*a*, for example. A simple press may be used in the place of such a roller.

When necessary, the preformed aggregate of filaments F obtained as described above is further passed through rubbing means, there to be rubbed such as with bars and compressed to a prescribed bulk density. The preformed aggregate of filaments thus obtained generally possesses a bulk density in the range of from 0.002 to 0.5 g/cm$^3$, preferably from 0.05 to 0.2 g/cm$^3$. Where the finished cushion is expected to possess higher impact resistance, the aggregate of filaments is subjected to the needling treatment similarly to the method of FIGS. 6–7. The compression of filaments may be effected by the rolling method, the rubbing method, etc. instead of the needling method.

When necessary, the aggregate of filaments which has been compressed and optionally subjected further to the needling treatment, for example, is now covered with a net 82. This net 82 may be the same as the aforementioned net 71 or may be similarly formed of wires of a smaller diameter. This net 82 is supplied from a separate net feeder 83. In this net feeder 83, as illustrated in FIG. 16, the net 82 paid off the roll 84 is passed over the feed roller 85, pressed between the press rollers 86*a*, 86*b*, then molded by the molding rollers 87*a*, 87*b* to a prescribed shape such as is similar to the surface contour of the molding die 80, and further pressed between similar press rollers 88*a*, 88*b*. Subsequently, this net 82 is pressed against the surface of the aforementioned mold 80 by a press roller 89. The press roller 89 has the same shape as the molding roller 87*a*. The net may be used in its original flat shape. Optionally, this net may be placed on the aggregate before the aggregate is subjected to compression, or it may be placed on the aggregate subsequently to the compression and before the needling treatment.

The molded aggregate of filaments F which has been obtained as described above is now subjected to the same treatments for application of adhesive liquid and application of heat as in the method of FIGS. 6–7.

The cushion which has been shaped as described above is treated with the heat of steam as desired either before or after it has been cut to a prescribed size. To be specific, the cushion is fed to a press provided with a steam injector and heated and compressed therein by steam blowing at a temperature in the range of from 100° to 140° C., preferably from 105° to 120° C. for a period in the range of from 1 to 30 minutes, preferably from 2 to 10 minutes. Then, the application of pressure is stopped and the blowing of steam is discontinued. The compressed cushion is cooled with air, water, etc. and removed from the press. Thus is obtained a finished cushion. This compression with steam is carried out so that the compression ratio based on the thickness of the crude cushion will fall in the range of from 5 to 40 percent, preferably from 10 to 30 percent.

As described above, this invention enjoys the advantage that it readily realizes the construction of the aggregate of filaments in a uniform layer height which the conventional mechanical method resorting to application of pressure with a solid body has found to be extremely difficult to attain because of the fluffiness of the aggregate. The present invention further enjoys the advantage that it readily permits the construction of the aggregate of filaments with a depressed contour which the conventional mechanical method resorting to application of pressure with a solid body has found to be extremely difficult to attain because of the fluffiness of the aggregate. This invention, in one aspect, involves, in addition to the basic procedure described above, the step of depositing the net on the conveyor means prior to the step of preforming. Where the aggregate of filaments to be formed happens to be complicate in shape and therefore highly susceptible of breakage or disintegration between the step of application of adhesive liquid and the step of drying, the net placed to cover the aggregate totally eliminates the possibility of such breakage. Further, since the net is left adhering to at least one surface of the finished cushion, there is no possibility of the cushion sustaining damage even when it is directly mounted on a spring such as of an automobile seat. The aforementioned advantage of the use of the net all the more improves when the net is used on a flat surface. The net may be applied to either the upper surface or the lower surface of the cushion, whichever fits the purpose. Optionally, the net may be applied to both surfaces of the cushion. The method for the manufacture of a cushion has been described with respect to a case wherein the net is placed first and the filaments are piled up on the net. It is naturally permissible to have the net placed on the aggregate of filaments after the aggregate has been compression molded.

What is claimed is:

1. A method for the preformation of a cushion for a seat with a prescribed, sculptured profile, characterized by forming a belt of fluffy, resiliently-compressible aggregate of three-dimensional, curled, short-fiber filaments on a conveyor means, causing said conveyor means carrying thereon said aggregate of filaments to be advanced under a rotary scraping member the outer surface of which comprises a multiplicy of transversely and circumferentially-spaced, axially-oriented, scraping needles while keeping said rotary scraping member in rotation and said scraping needles in contact with the advancing aggregate of filaments in a manner such that part of the filaments is scraped from surface portions of said aggregate to give said aggregate of filaments the desired prescribed, sculptured profile, wherein the scraping is effected across substantially the entire width of the aggregate of filaments with the transversely-disposed needles having different lengths corresponding to a prescribed, sculptured transverse profile.

2. A method for the preformation of a cushion for a seat, characterized by feeding an aggregate of three-dimensional, curled, short-fiber filaments to a conveyor means, causing said conveyor carrying thereon said aggregate of filaments to be advanced under a rotary member provided on the outer surface thereof with a multiplicy of raised needles and kept in rotation and allowing said needles to come into contact with said aggregate of filaments, thereby scraping part of the filaments from said aggregate and giving to said aggregate of filaments a prescribed shape and by the rotary member being rotated while the axis thereof is vertically reciprocated.

3. A method for the preformation of a cushion for a seat with a prescribed, sculptured profile, characterized by forming a belt of fluffy, resiliently-compressible aggregate of three-diminsional, curled, short-fiber filaments on a conveyor means, causing said conveyor means carrying thereon said aggregate of filaments to be advanced under a rotary scraping member, the outer surface of which comprises a multiplicity of transversely and circumferentially-spaced, axially-oriented, scraping needles while keeping said rotary scraping member in rotation and said scraping needles in contact with the advancing aggregate of filaments in a manner such that part of the filaments is scraped from surface portions of said aggregate to give said aggregate of filaments the desired prescribed, sculptured profile; and wherein a molding die is fixed on the conveyor means and extends across at least the major portion of the width thereof, said molding die having a configuration such that a sculptured effect is given to the bottom of said aggregate of filaments without punching holes therein.

4. A method according to claim 3, wherein said molding die is sculptured transversely, whereby the bottom of said aggregate of filaments is sculptured transversely.

5. A method according to claim 3, wherein said molding die is sculptured longitudinally, whereby the bottom of said aggregate of filaments is sculptured longitudinally.

6. A method for the manufacure of a cushion, characterized by forming a belt of an aggregate of three-dimensionally curled, short-fiber filaments onto a net on a belt conveyor means, causing said conveyor means carrying thereon the belt of said aggregate of filaments with said net therebetween to be advanced under a rotary scraping member, the outer surface of which comprises a multiplicity of transversely and circumferentially-spaced, axially-oriented, scraping needles while keeping said rotary scraping member in rotation and said needles in contact with the advancing aggregate of filaments in a manner such that part of the filaments is scraped from said aggregate to preform the aggregate in a prescribed shape, compressing the thus formed preformed aggregate, thereby enabling the aggregate to acquire a prescribed bulk density, subsequently applying an adhesive liquid to impregnate said preformed and compressed aggregate, vertically lifing the belt of preformed, compressed, and impregnated aggregate wet with the adhesive liquid in conjunction with said net which functions to prevent rupture of the wet aggregate, and heating the wet aggregate to dry the same, wherein the scraping is effected across substantially the entire width of the aggregate of filaments with the transversely-disposed needles having different lengths corresponding to a prescribed, suclptured, transverse profile.

7. A method for the manufacture of a cushion, characterized by feeding an aggregate of three-dimensionally, curled, short-fiber filaments onto a net on a conveyor means, causing said conveyor means carrying thereon said aggregate of filaments to be advanced under a rotary member provided on the outer surface thereof with a multiplicy of raised needles and kept in rotation and allowing said needles to come into contact with said aggregate of filaments thereby scraping part of the filaments from said aggregate and preforming the aggregate in a prescribed shape, compressing said preformed aggregate, thereby enabling the aggregate to acquire prescribed bulk density, subsequently applying an adhesive liquid to said preformed aggregate, and lifting and heating the preformed aggregate wet with the adhesive liquid in conjunction with said net thereby drying the aggregate, by the scraping being effected partially on the surface of the aggregate of filaments, and by the rotary member being rotated while the axis thereof is vertically reciprocated.

8. A method for the manufacture of a cushion, characterized by forming a belt of an aggregate of three-dimensionally curled, short-fiber filaments onto a net on a belt conveyor means, causing said conveyor means carrying thereon the belt of said aggregate of filaments with said net therebetween to be advanced under a rotary scraping member, the outer surface of which comprises a multiplicity of transversely and circumferentially-spaced, axially-oriented, scraping needles while keeping said rotary scraping member in rotation and said needles in contact with the advancing aggregate of filaments in a manner such that part of the filaments is scraped from said aggregate to preform the aggregate in a prescribed shape, compressing the thus formed preformed aggregate, thereby enabling the aggregate to acquire a prescribed bulk density, subsequently applying an adhesive liquid to impregnate said preformed and compressed aggregate, vertically lifting the belt of preformed, compressed, and impregnated aggregate wet with the adhesive liquid in conjunction with said net which functions to prevent rupture of the wet aggregate, and heating the wet aggregate to dry the same, and wherein a molding die is fixed on the conveyor means, and extends across at least the major portion of the width thereof, said molding die having a configuration such that a sculptured effect is given to the bottom of said aggregate of filaments without punching holes therein.

9. A method according to claim 8, wherein said molding die is sculptured longitudinally, whereby the bottom of said aggregate of filaments is sculptured longitudinally.

10. A method according to claim 8, wherein said molding die is sculptured transversely, whereby the bottom of said aggregate of filaments is sculptured transversely.

11. A method according to claim 8, wherein said molding die is sculptured longitudinally, whereby the bottom of said aggregate of filaments is sculptured longitudinally.

12. A method for the manufacture of a cushion, characterized by forming a belt of an aggregate of three-dimensionally curled, short-fiber filaments onto a net on a belt conveyor means, causing said conveyor means carrying thereon the belt of said aggregate of filaments with said net therebetween to be advanced under a rotary scraping member, the outer surface of which comprises a multiplicity of transversely and circumferentially-spaced, axially-oriented, scraping needles while keeping said rotary scraping member in rotation and said needles in contact with the advancing aggregate of filaments said needles in contact with the advancing aggregate of filaments in a manner such that part of the filaments is scraped from said aggregate to preform the aggregate in a prescribed shape, compressing the thus formed preformed aggregate, thereby enabling the aggregate to acquire a prescribed bulk density, subsequently applying an adhesive liquid to impregnate said preformed and compressed aggregate, vertically lifting the belt of preformed, compressed, and impregnated aggregate wet with the adhesive liquid in conjunction with said net which functions to prevent rupture of the wet aggregate, and heating the wet aggregate to dry the same; wherein a molding die is fixed on the conveyor means, and extends across at least the major portion of the width thereof, said molding die having a configuration such that a sculptured effect is given to the bottom of said aggregate of filaments without punching holes therein and, wherein the net is preshaped in conformity with the contour of the molding die and thereafter fed to said molding die.

13. An apparatus for the preformation of a cushion for a seat with a prescribed, sculptured profile, comprising conveyor means, means for forming a belt of fluffy, resiliently-compressible aggregate of three-dimensionally curled, short-fiber filaments and scraping means formed of a rotary scraping member disposed transversely on said conveyor means and comprising at the outer surface thereof a multiplicity of transversely and circumferentially-spaced, axially-oriented, scraping needles having a sculpturing transverse profile corresponding to the desired prescribed, sculptured profile, and wherein the rotary member comprises a cylindrical body which has a fixed diameter and wherein said needles project axially and extend over substantially the entire width of the conveyor means with the transversely-disposed needles having different lengths corresponding to a prescribed sculptured, transverse profile.

14. An apparatus for the preformation of a cushion for a seat with a prescribed, sculptured profile, comprising conveyor means, means for forming a belt of fluffy, resiliently-compressible aggregate of three-dimensionally curled, short-fiber filaments and scraping means formed of a rotary scraping member disposed transversely on said conveyor means and comprising at the outer surface thereof a multiplicity of transversely and circumferentially-spaced, axially-oriented, scraping needles having a sculpturing transverse profile corresponding to the desired prescribed, sculptured profile, and which further comprises means for causing said rotary member to be vertically reciprocated while said rotary member is being rotated, whereby the surface of said aggregate of filaments is sculptured longitudinally.

15. An apparatus for the preformation of a cushion with a prescribed, sculptured profile, comprising sequentially a cushion preformer adapted to preform an aggregate of three-dimensionally curled, short-fiber filaments into a preformed cushion in conjunction with a net, means for compressing said preformed cushion including said net, means for applying an adhesive liquid to the compressed, preformed cushion including said net, and drying means, said cushion preformer being formed of conveyor means for said aggregate of three-dimensionally curled, short-fiber filaments and said net and scraping means consisting of a rotary member disposed on said conveyor means and provided on the outer surface thereof with a multiplicity of transversely and circumferentially-spaced, axially-oriented, scraping needles having a sculpturing profile corresponding to a prescribed, sculptured, transverse profile, and wherein the rotary member comprises a cylindrical body which has a fixed diameter and wherein said needles extend over substantially the entire width of the conveyor means and wherein said needles project axially from such cylindrical body with the transversely-disposed needles having different lengths corresponding to a prescribed, sculptured, transverse profile.

16. An apparatus for the preformation of a cushion with a prescribed, sculptured profile, comprising sequentially a cushion preformer adapted to preform an aggregate of three-dimensionally curled, short-fiber filaments into a preformed cushion in conjunction with a net, means for compressing said preformed cushion including said net, means for applying an adhesive liquid to the compressed, preformed cushion including said net, and drying means, said cushion preformer being formed of conveyor means for said aggregate of three-dimensionally curled short-fiber filaments and said net and scraping means consisting of a rotary member disposed on said conveyor means and provided on the outer surface thereof with a multiplicity of transversely and circumferentially-spaced, axially-oriented, scraping needles having a sculpturing profile corresponding to a prescribed, sculptured, transverse profile, and which further comprises means for causing said rotary member to be vertically reciprocated while said rotary member is being rotated, whereby the surface of said aggregate of filaments is sculptured longitudinally.

17. An apparatus for the manufacture of a cushion with a prescribed, sculptured profile, comprising sequentially a cushion preformer adapted to preform an aggregate of three-dimensionally curled, short-fiber filaments into a preformed cushion in conjunction with a net, means for compressing said preformed cushion including said net, means for applying an adhesive liquid to the compressed, preformed cushion including said net, and drying means, said cushion preformer being formed of conveyor means for said aggregate of three-dimensionally curled, short-fiber filaments and said net and scraping means consisting of a rotary member disposed on said conveyor means and provided on the outer surface thereof with a multiplicity of transversely and circumferentially-spaced, axially-oriented, scraping needles having a sculpturing profile corresponding to a prescribed sculptured, transverse profile; wherein a molding die is fixed on the conveyor means and extends across at least the major portion of the width thereof, said molding die having a configuration such that a sculptured effect is given to the bottom of said aggregate of filaments without punching holes therein and, which further comprises means for shaping the net in conformity with the contour of the molding die and for thereafter feeding it to overlie said molding die and to underlie the belt of said aggregate.

* * * * *

UNITED STATES PATENT AND TRADEMARK OFFICE

CERTIFICATE OF CORRECTION

PATENT NO. : 4,619,723

DATED : October 28, 1986

INVENTOR(S) : Sadaaki Takagi

It is certified that error appears in the above-identified patent and that said Letters Patent is hereby corrected as shown below:

Col. 3, line 11; "complicate" should read -- complicated --
Col. 3, line 19; "complicate" should read -- complicated --
Col. 8, line 6; "but" should read -- by --
Col. 9, line 12; "countour" should read -- contour --
Col. 9, line 16; "controured" should read -- contoured --
Col. 12, line 11; "preformer 7" should read -- preformer 10 --
Col. 15, line 14; "complicate" should read -- complicated --
Col. 15, line 53; after "sculptured" insert a comma -- , --
Col. 16, line 52; "suclptured" should read -- sculptured --
Col. 16, line 62; after "filaments" insert a comma -- , --
Col. 17, lines 58 & 59; delete "said needles in contact with the advancing aggregate of filaments"
Col. 18, line 42; "preformation" should read -- manufacture --

Col. 18, line 66; "preformation" should read -- manufacture --

Col. 19, line 8; after "curled" insert a comma -- , --

Signed and Sealed this

Fourteenth Day of April, 1987

*Attest:*

DONALD J. QUIGG

*Attesting Officer*

*Commissioner of Patents and Trademarks*